United States Patent [19]

Ogawa

[11] 4,283,866

[45] Aug. 18, 1981

[54] CONVERTIBLE BUCKET ATTACHMENT CAPABLE OF EXCAVATION AND CLASPING

[76] Inventor: Junji Ogawa, No. 22-13, 2-chome, Hagioka, Hamamatsh-shi, Shizuoka-ken, Japan

[21] Appl. No.: 121,733

[22] Filed: Feb. 15, 1980

[30] Foreign Application Priority Data

Feb. 17, 1979 [JP] Japan ..... 54/19137[U]

[51] Int. Cl.[3] ..... E02F 3/70

[52] U.S. Cl. ..... 37/117.5

[58] Field of Search ..... 37/117.5, 103, 2 R, 37/118 A, DIG. 3

[56] References Cited

U.S. PATENT DOCUMENTS

| | | | |
|---|---|---|---|
| 2,470,779 | 5/1949 | Lankovski et al. | 37/118 A |
| 3,148,465 | 9/1964 | Beyerstedt et al. | 37/117.5 |
| 3,243,067 | 3/1966 | Artman | 37/117.5 X |
| 3,250,028 | 5/1966 | Hunger et al. | 37/117.5 |
| 3,854,608 | 12/1974 | Arnold | 37/117.5 X |

FOREIGN PATENT DOCUMENTS

| | | | |
|---|---|---|---|
| 624993 | 8/1978 | U.S.S.R. | 37/103 |

*Primary Examiner*—E. H. Eickholt

*Attorney, Agent, or Firm*—Armstrong, Nikaido, Marmelstein & Kubovcik

[57] ABSTRACT

A convertible bucket attachment for excavation and clasping comprising a bucket portion consisting of a bucket proper and a complementary sub-bucket and connected to a rocking arm of an excavator machine, the bucket proper and the sub-bucket being rockingly connected to each other in the upper portions, upper link members having one end pivotally secured to the bucket proper and another end connected to the distal end of the plunger rod of a cylinder actuator, sub-link members connected at one end to the excavator arm and rockingly supporting the upper link members, and lower link members pivotally secured to the sub-bucket at one end and associated with the upper link members and sub-link members. The bucket attachment can perform both operations of excavation and clasping by means of one single cylinder actuator.

5 Claims, 8 Drawing Figures

CONVERTIBLE BUCKET ATTACHMENT CAPABLE OF EXCAVATION AND CLASPING

SUMMARY OF THE INVENTION

This invention relates to a working attachment adapted to be mounted in the distal end of the arm of an excavator machine for civil engineering, and in detail to a novel convertible bucket attachment consisting of two complementary members to function for excavation and clasp of objects, and further having a plurality of interconnected links in combination, thereby permitting both operations of excavation and clasp of objects to be made from one single hydraulic cylinder actuator.

Excavation of soils and clasp of objects such as timber, etc. constitute different phases of civil engineering working made by mechanical power so that, conventionally, separate kinds of attachments have been provided for these respective purposes and the attachments have been to be replaced in the arm of an engineering machine as required by the intended operations. The conventional attachments have, however, rendered it impossible to continuously shift from excavation and clasping and vice versa, and when mounted or demounted for replacement, have required very awkward operations, thus not only lowering efficiency of the engineering working overall, but causing frequent accidents injurious to the human bodies.

A bucket apparatus which is directed to overcoming the above stated drawbacks was known in, for example, Japanese Patent Pre-publication No. 5201/1973 with priority claimed from U.S. patent applications Ser. Nos. 133,501 and 203,977, where the apparatus has a back and a fore bucket pivoted to allow operations of excavation and clasping. In the known apparatus, however, an extra cylinder actuator has been required to actuate the back and the fore bucket away from and toward each other, in addition to a cylinder actuator for rocking the back bucket. The back and the fore bucket have been unable to be actuated away from and toward each other, in association with rocking of the back bucket, by one single cylinder actuator. Two separate cylinder actuators have thus had to be operated to achieve both actuations of the buckets, so that the excavating operation could not be made in a close association with the clasping operation, thus rendering it feasible to shift continuously between the both kinds of operations. Moreover, provision of a cylinder actuator between the back and the fore bucket has imposed a substantial limitation on the distance of range in which both bucket members can be operatively moved relative to each other, and prevented the range of angular movement of the members from being as wide as 180° as in the embodiment of the invention. The cylinder actuator for actuating the back and the fore bucket away from and toward each other is located in a position such that it directly contacts with soils, stones, etc. after excavated, so that it is likely to be soiled or damaged, and more significantly disadvantageously, stones once caught therein may often hinder the relative movement between the bucket members.

Accordingly, one of the objects of the invention is to provide a convertible bucket attachment consisting of a bucket proper and a complementary sub-bucket pivotally secured at the respective ends to each other about a common aperture to function for excavation and clasping, and at the same time to permit both operations of excavation and clasping to be made by one single cylinder actuator.

Another object of the invention is to provide a convertible bucket attachment which can be smoothly, easily actuated to continuously shift between the operations of excavation and clasping and is not hindered from the function of clasping by stones, etc. excavated.

A still other object of the invention is to provide a convertible bucket attachment having a pair of brackets each to which the joining portions of the bucket proper and the sub-bucket and the lower pivot of the sub-link member are pivotally secured, forming an integral arrangement which permits the attachment to be mounted in the arm of any type of excavator machines and dispenses with determination of a dimension of the position that the lower end of the sub-link member be pivotally secured for mounting of the attachment.

A further object of the invention is to provide a convertible bucket attachment having a bucket proper and a complementary sub-bucket pivotally secured to each other by the intermediary of a hollow bush which has a flange portion of various thicknesses to facilitate mounting of the attachment to the machine arms and permit mounting thereof in a close-fit relationship to any machine arms whose transverse width may vary.

A still further object of the invention is to provide a bucket attachment capable of loading excavated soils and clasped timbers, etc. on carrier vehicles, without impacting loading floors of the vehicles.

The foregoing objects and other objects as well as the characteristic features of the invention will become more apparent and more readily understandable by the following description and the appended claims when read in conjunction with the accompanying drawings.

Detailed Description of the Preferred Embodiments of the Invention

Figure 1:
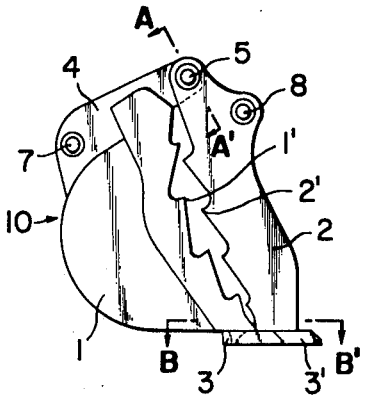
FIGS. 1 and 2 are a side and a front view, respectively, of the bucket portion of a bucket attachment embodied by the invention.
Figure 2:
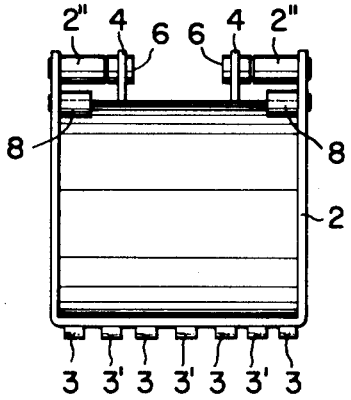
Figure 3:
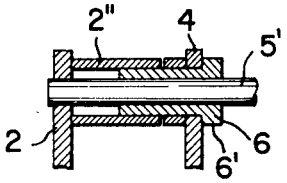
FIG. 3 is a sectional view taken along line A—A′ of FIG. 1.

FIGS. 1 and 2 show the bucket portion 10 of a bucket attachment of the invention which consists of a bucket proper 1 and a complementary sub-bucket 2. The bucket proper 1 has a pair of stays 4,4 rigidly secured in the upper portion, and the remote ends of the pair of stays 4,4 and the upper ends of the lateral side walls of the sub-bucket 2 are pivotally engaged with each other through hollow bushes 6,6 fitted in common pivot apertures 5,5. The common pivot apertures 5,5 receive therethrough a pin 5′ to serve for pivotal mounting of the attachment to the arm of an excavator machine. Because of embossments 2" of the sub-bucket 2 and the bucket proper 1 are, as shown in FIG. 3, pivotally engaged with each other through the above mentioned bushes 6, the bucket proper 1 and the sub-bucket 2 are kept to be connected to each other without the pin 5' fitted therethrough, which facilitates transportation and mounting of the bucket attachment to the machine arm, without necessity of re-assembling of the bucket attachment.

The above mentioned bushes 6 are provided with flanges 6' whose thickness may selectively vary. Selection of the thickness of the bush flanges permits the bucket portion 10 and the machine arm 11 to be connected in a close-fit relationship to each other even when the machine arm 11 to which the bucket portion is pivotally secured by the pin 5' extending from one to another bush 6 has various widths.

The bucket proper 1 and the complementary sub-bucket 2 are provided along respectively opposed side edges with series of suitably shaped, mutually spaced projections 1',2'. A plurality of pawls 3,3' may be provided, if desired, at the bottom edges of the bucket proper 1 and the sub-bucket 2 to meshingly engage with each other.

The pair of stays 4,4 carried in the upper portion of the bucket proper 1 have link apertures 7,7 formed in the fore ends, respectively. Each of the side plates of the sub-bucket 2 has link aperture 8 formed to be positioned adjacently below the above mentioned pivot aperture 5.

Figure 4A:
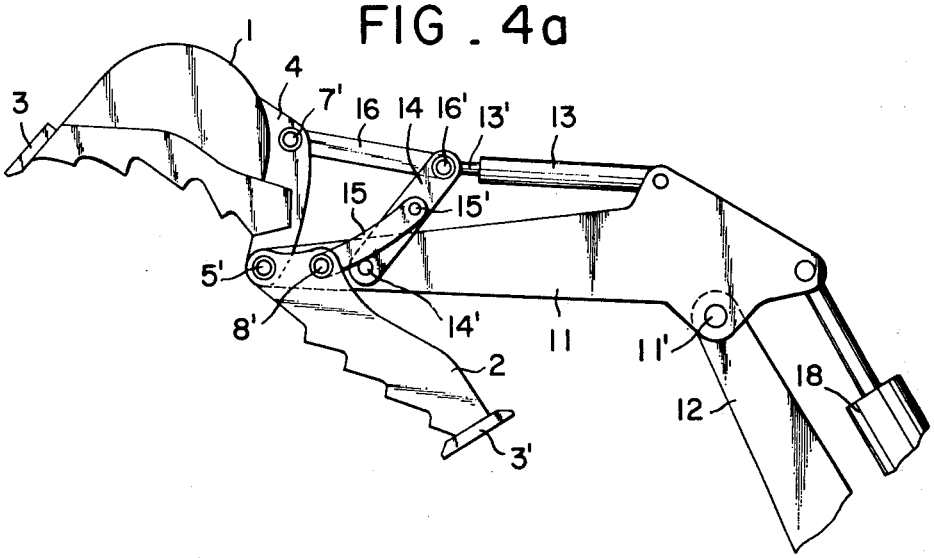
FIGS. 4*a* and 4*b* are both side views showing a link arrangement of the invention connecting the bucket attachment to the arm and the cylinder actuator, the bucket portion being shown as open in FIG. 4*a* and shown as closed with an object clasped therein in FIG. 4*b;*

As shown in FIG. 4*a*, a pair of upper link members 16,16 each have one end pivotally secured by a pin 7' in the link apertures 7,7 formed in the laterally opposed stays of the bucket proper, and another end connected to the free end of the plunger rod 13' of a cylinder actuator 13. A pair of sub-link members 14,14 each are supported pivotally at one end on the above mentioned arm and also pivotally secured at the other end to each of the upper link members 16,16 so that the sub-link members 14,14 can be moved in association with the upper link members actuated by the plunger rod 13'. On the other hand, a pair of lower link members 15,15 each have one end pivotally secured by a pin 8' in each of the above mentioned link apertures 8,8 of the sub-bucket side plates and the other end also pivotally secured to the intermediate portion of each of the above mentioned sub-link member 14,14.

The arm 11 is supported for rocking movement on the boom 12 of an excavator machine and can be rocked about a pivot 11' by means of separate cylinder actuator 18 or the like.

Figure 5:
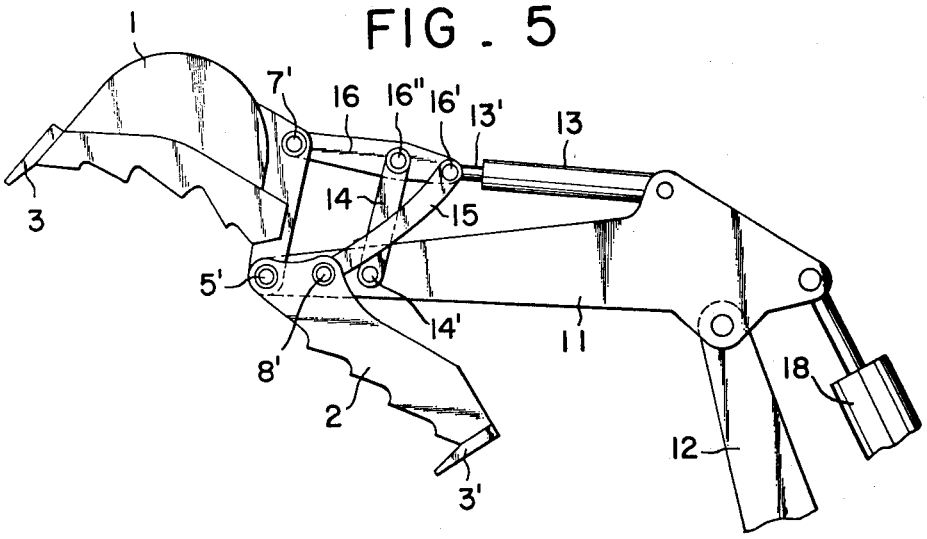
FIG. 5 is a side view showing a link arrangement of another embodiment of the invention connecting the bucket attachment thereto.

Referring to FIG. 5 in which a similar bucket attachment, but with a link arrangement modified, is shown, each of lower link members 15,15 pivotally secured in the link aperture 8 of sub-bucket 2 at one end has the other end connected by a pin 16' pivotally to the distal end of the plunger rod 13 to which the distal end of each of upper link members 16,16 is also pivotally connected. Each of sub-link members 14,14 is pivotally connected to the intermediate portion of each of the upper link members 16,16.

Figure 6:
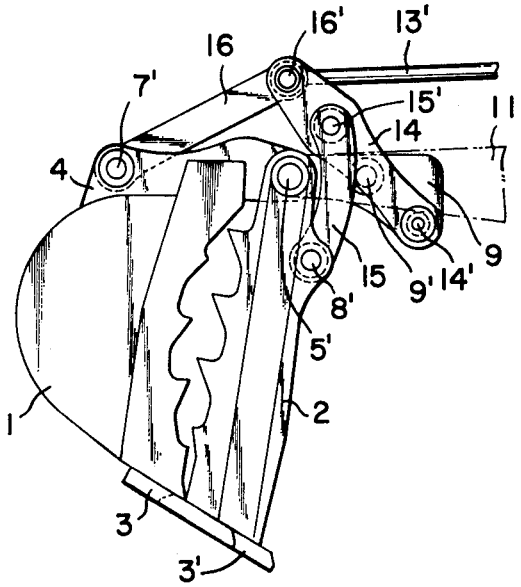
FIG. 6 is a side view showing a modification of the invention where a bracket is used to connect the bucket portion and sub-link member to the machine arm.
Figure 7:
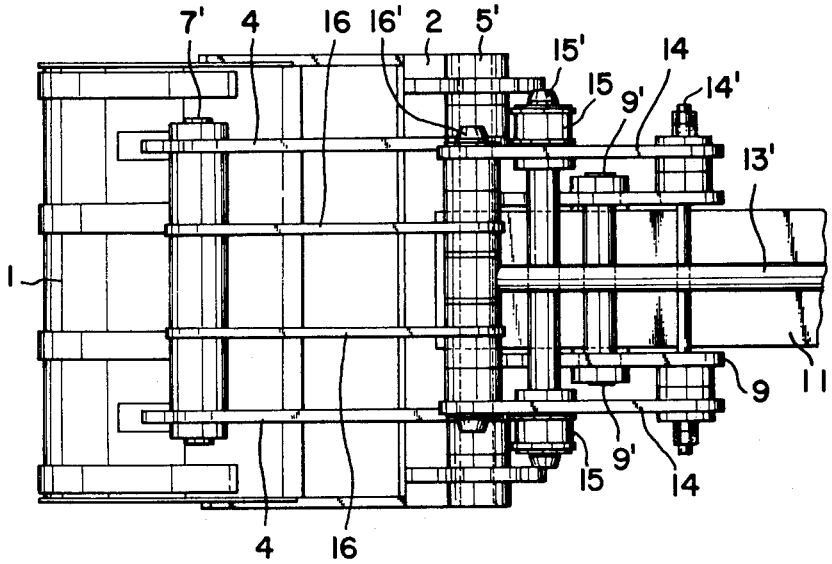
FIG. 7 is a magnified plan view of the bucket attachment shown in FIG. 6.

In a modification shown in FIG. 6, pivotal engaging portions of bucket proper 1 and sub-bucket 2 and the lower end pivot 14' of sub-link members are preliminarily disposed in one single bracket 9, with any other link members arranged in a determined relationship to each other. The arrangement thus provided permits the lower end pivots of the sub-link members to be located in an offset position relative to the machine arm, and renders it unnecessary to make positioning of the lower end pivots of the sub-link members because of the position of sub-link lower end pivots being determined in the link arrangement. Obviously, the bracket 9 may be rigidly secured onto the inner opposed sides of the machine arm 11 by the intermediary of the above mentioned pin 5' and a mount portion 9' as shown in FIGS. 6 and 7.

Bucket members, link members and other members hereinabove referred to are all made of steel and/or any known tough materials.

Figure 4B:
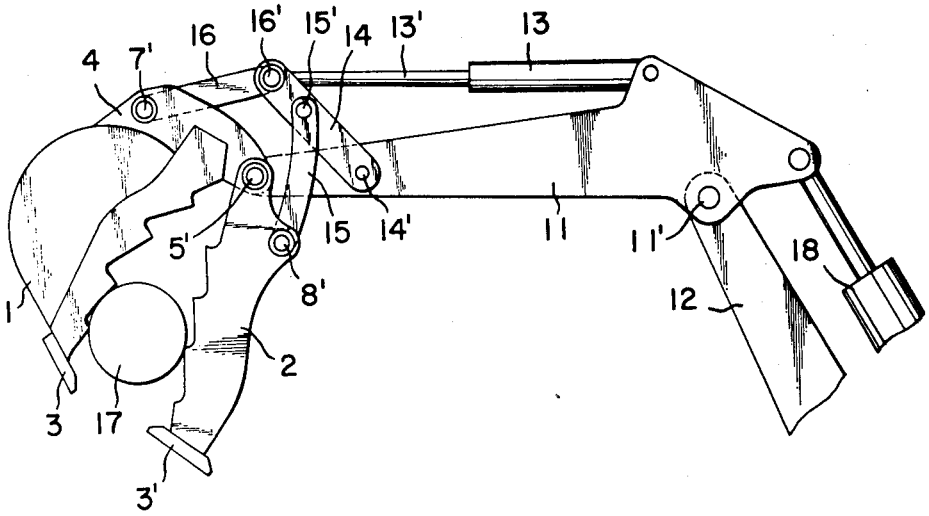

In operation of the embodiments hereinabove stated, when the plunger rod 13' is drawn toward the cylinder 13, the bucket proper land sub-bucket 2 are, as shown in FIG. 4*a*, pivotally moved about the pivot engaging portions in the opposed directions or away from each other. When the plunger rod 13' is pushed out, the bucket proper 1 is actuated to excavate and scoop soils, etc. and the sub-bucket 2 is in association is rocked toward the bucket proper 1 to serve for effectively holding almost all the material excavated. Operation of clasping an object such as timber 17 as shown in FIG. 4*b* can be independently performed, if necessary, by means of the cylinder actuator 13. When a greater amount of soils are desired to be excavated by one scoop, the arm 11 may be rocked by means of cylinder actuator 18 to drive the bucket proper 1 into the earth, with the bucket proper being positioned away from the sub-bucket 2, and then the cylinder actuator rod 13' may be pushed out to rock the bucket proper and the sub-bucket about the pivotal engaging portions toward each other.

It can be understood from the foregoing that the bucket attachment of the invention is capable of performing both operations of excavation by the bucket proper and clasping by the bucket proper and the sub-bucket in a free, continuous manner, thanks to the associated link arrangement actuated by one single cylinder actuator 13.

What is claimed is:

1. A convertible bucket attachment for excavation and clasping adapted to be rockingly mounted to an arm which in turn is rockingly connected to a boom of an excavator machine, comprising:

a bucket portion 10 consisting of a bucket proper 1 and a complementary sub-bucket 2 pivotally engaged in the upper ends for a rocking movement by a pair of common pivot apertures 5,5 for connection of said bucket portion to the distal end of the arm of an excavator machine;

a pair of upper stays 4,4 disposed in said proper bucket 1 and each having an upper link aperture;

a pair of upper link members 16,16 each having one end pivotally secured in said upper link aperture and the other end pivotally secured to the distal end of a plunger rod;

a pair of sub-link members 14,14 each having one end pivotally secured to one another opposed side plates of the arm and the other end pivotally secured to one another of said upper link members for association therewith; and a pair of lower link members 15,15 each having one end pivotally secured to said sub-bucket 2 substantially below said common pivot aperture and associated with said upper link members and said sub-link members; thereby forming a link arrangement which is adapted to be actuated by one single cylinder actuator 13 to allow said bucket proper 1 and said sub-bucket 2 to perform operations of excavation and clasping.

2. The convertible bucket attachment for excavation and clasping defined in claim 1, where said pair of lower link members 15,15 each have one end pivotally secured to one another opposed side plates of said sub-bucket 2 and another end pivotally secured to one another of said pair of sub-link members 14,14.

3. The convertible bucket attachment for excavation and clasping defined in claim 1, where said pair of lower link members 15,15 each have one end pivotally secured to one another opposed side plates of said sub-bucket 2 and another end pivotally secured to one another of said pair of upper link members 16,16.

4. The convertible bucket attachment for excavation and clasping defined in claim 1, where the pivotal engaging portions of said bucket proper and said sub-bucket and said sub-link members are preliminarily pivotally secured to one single integral bucket by the intermediary of which said bucket attachment is adapted to be mounted to the arm.

5. The convertible bucket attachment for excavation and clasping defined in any of claims 1, 2, 3 or 4, where the pivotal engaging portions of said bucket proper 1 and sub-bucket 2 are preliminarily connected to each other, with hollow bush 6 fitted therein and having a flange 6' of various thicknesses.

* * * * *